United States Patent [19]

Robertson

[11] Patent Number: 4,506,999

[45] Date of Patent: Mar. 26, 1985

[54] PROGRAM CONTROLLED PIN MATRIX EMBOSSING APPARATUS

[75] Inventor: John A. Robertson, Chillicothe, Ohio

[73] Assignee: Telesis Controls Corporation, Chillicothe, Ohio

[21] Appl. No.: 512,984

[22] Filed: Jul. 12, 1983

[51] Int. Cl.[3] ..... B41J 3/10

[52] U.S. Cl. ..... 400/121; 400/127; 400/181; 101/3 R; 91/417 R

[58] Field of Search ..... 400/121, 124, 181, 127; 101/3 R, 4, 35, 18; 91/417 R; 173/134, 10, 17, 101; 184/55 A

[56] References Cited

U.S. PATENT DOCUMENTS

| | | | |
|---|---|---|---|
| 2,565,242 | 8/1951 | Lane | 91/417 R |
| 2,596,721 | 5/1952 | Pentecost et al. | 101/18 |
| 2,644,307 | 7/1953 | Blair | 91/417 R X |
| 2,646,746 | 7/1953 | Muller, Sr. | 101/4 |
| 2,776,617 | 1/1957 | Hendrickson | 101/4 |
| 2,875,684 | 3/1959 | Teel | 101/3 R |
| 3,033,170 | 5/1962 | Norton et al. | 91/417 R X |
| 3,118,370 | 1/1964 | Johnson et al. | 101/4 |
| 3,120,175 | 2/1964 | Martin | 101/4 |
| 3,211,088 | 10/1965 | Naiman | 101/114 |
| 3,226,530 | 12/1965 | Greenblott et al. | 400/124 X |
| 3,298,030 | 1/1967 | Lewis et al. | 346/75 |
| 3,397,403 | 8/1968 | Greene | 400/181 X |
| 3,560,641 | 2/1971 | Taylor et al. | 346/75 X |
| 3,566,828 | 3/1971 | Christensen | 118/316 X |
| 3,584,571 | 6/1971 | Schmoll | 101/1 |
| 3,585,928 | 6/1971 | Kaneko | 101/1 X |
| 3,588,906 | 6/1971 | Van Brimer et al. | 346/1 |
| 3,625,142 | 12/1971 | Bresler | 346/78 X |
| 3,656,169 | 4/1972 | Kashio | 346/1 |
| 3,892,174 | 7/1975 | Marcher | 101/35 |
| 4,025,925 | 5/1977 | Jensen et al. | 346/75 |
| 4,059,183 | 11/1977 | Hoskins | 346/75 X |
| 4,084,259 | 4/1978 | Cahill et al. | 346/78 X |
| 4,094,383 | 6/1978 | Thrasher, Jr. | 184/55 A |
| 4,115,787 | 9/1978 | Fujimoto et al. | 346/75 |
| 4,115,788 | 9/1978 | Takano et al. | 346/75 |
| 4,128,345 | 12/1978 | Brady | 346/75 X |
| 4,210,919 | 7/1980 | Aiba | 346/75 |
| 4,218,971 | 8/1980 | Uhl et al. | 400/181 X |
| 4,239,402 | 12/1980 | Jung et al. | 400/124 X |
| 4,345,260 | 8/1982 | Deproux | 346/75 |
| 4,347,519 | 8/1982 | Kikuchi et al. | 346/75 |
| 4,348,120 | 9/1982 | Isobe et al. | 400/124 |
| 4,349,283 | 9/1982 | Sapitowicz et al. | 400/124 |
| 4,354,195 | 10/1982 | Oomori et al. | 346/75 |
| 4,359,937 | 11/1982 | Helinski | 101/93.04 |
| 4,365,198 | 12/1982 | Toth | 324/226 |
| 4,408,907 | 10/1983 | Bernardis | 400/124 |

*Primary Examiner*—Clifford D. Crowder
*Attorney, Agent, or Firm*—Mueller and Smith

[57] ABSTRACT

Apparatus for forming multi-character messages on the surfaces of solid materials wherein an array of marker pins (88–94) are selectively pneumatically actuated from a corresponding array of solenoid actuated valves (102–104, 106). The marker pins are returned to their operational ready position by a select pneumatic input (96) which performs in conjunction with a pressure limiting valve (126). Continuous monitoring of marker pin performance is carried out by a transducer (166) operating in conjunction with a monitoring duct (168) and selectively located monitoring openings (**168*a*–168*g*). The marker pins readily are accessed for maintenance in consequence of their positioning within a head structure (12) having access openings at one end (78) and which is retained in position by ball lock pins (64, 65**).

20 Claims, 23 Drawing Figures

FIG. 6
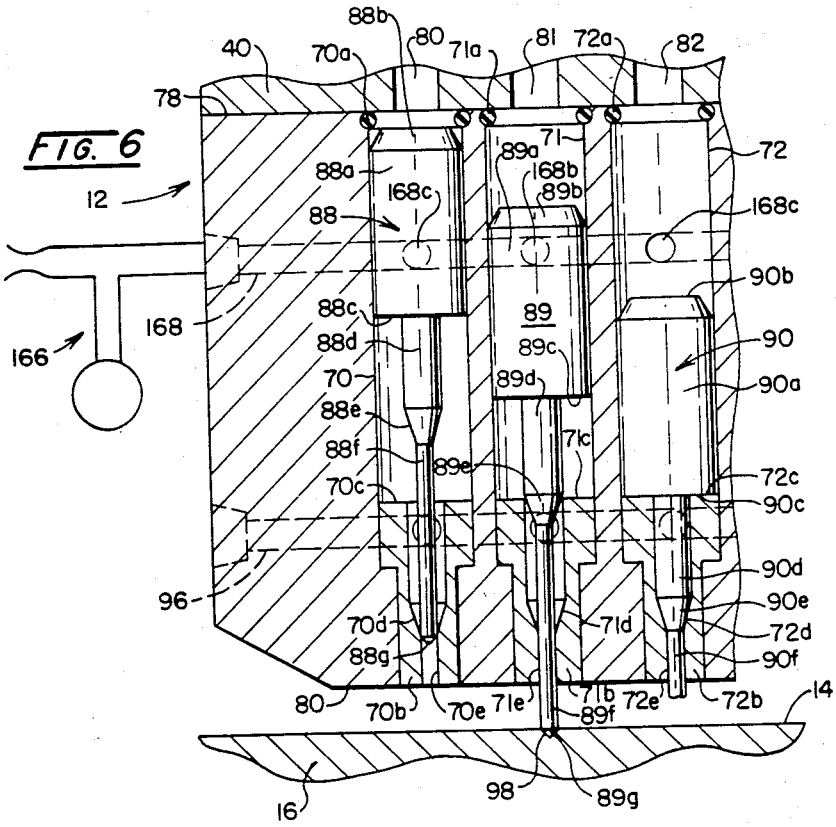
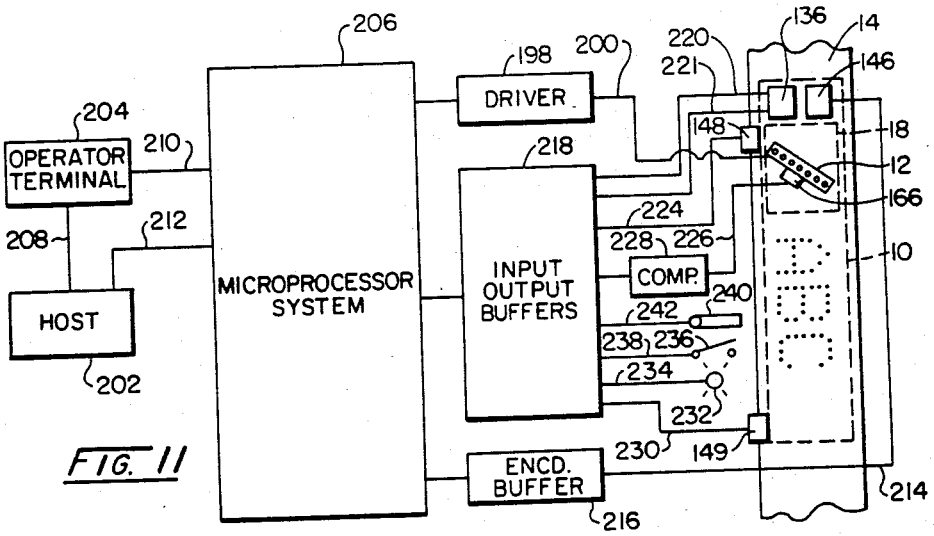
FIG. 11

PROGRAM CONTROLLED PIN MATRIX EMBOSSING APPARATUS

BACKGROUND

Requirements have developed in many industries to devise techniques for tracing the history of a product through the course of a multi-stage production process. Where this production involves rigorous materials treatment or is one which is carried out within a harsh industrial environment, the development of effective traceable marking techniques becomes an elusive task.

One such vigorous production environment is encountered in the steel and other metals industry where the materials generated find their genesis in a given batch number or melt of scientifically orchestrated alloying components. From the point in production where such a melt becomes a solid entity, it is desired that the originating melt identification be maintained. Such points in production vary widely within the industry. For example, metal solidification may be evolved from a continuous casting process or as discrete ingots. Where the ingots are formed, a next process procedure may be to develop a bloom which, in turn, may be used as or converted into a billet. Ultimately, the starting material becomes an end product such as a length of pipe or the like.

The provision of a traceable marking upon the solidified materials as they exist within all stages of their production has not been effectively achieved with conventional devices and techniques. For example, paint markings or the like are unacceptable inasmuch as they will be expunged in the course of the production process. Such markings also may be lost as raw materials are stored in the open and undergo rust and corrosion. Very often, the metal materials will be treated by grinding or the like such that many forms of marking would be removed. Additionally, the rigorous environment involved in many processes calls for a remote human attendance to the procedure of marking. Thus, some remote form of attendance should be made available. Because a large number of different products and starting materials may be involved in any production facility, a traceable marking system suited therefor should have a message flexibility to provide adequate identification of each individual element. Further, it very often is desirable to serialize the markings positioned upon individual components of a given production run. It has been observed that certain end product user entities, for example, in the petroleum production industries, now require that a production traceable coding having a long term permanence be incorporated within products. With such coding, in the event of failure after a long period of use, the manufacturing parameters then can be traced and evaluated.

For the most part, a required permanence of the marking can be achieved through some form of stamping technique. However, the development of a required flexibility in message selection has not been available in industry. Stamping approaches have, for example, utilized dies which carry a collection of full form characters sometimes referred to as "full faced dies". These characters may be positioned in a wheel or in a ball form of die carrier which is manipulated to define a necessarily short message and is dynamically struck into the material to be marked. As is apparent, the necessarily complex materials involved are prone to failure and the full faced dies exhibit rapid wear characteristics.

Because of the necessary size of the resultant marking mechanism, the message length becomes limited to an overly restricted and somewhat impractical extent.

SUMMARY

The present invention is addressed to apparatus and system for creating messages upon the surface of solid materials through the use of an array of indenting marker pins which are selectively actuated to form character defined messages. Such formation is developed through a combination of character defining pixels indented within the surface of the mark material. The marking pins of the apparatus are structured having piston portions which slidably ride within corresponding chambers wherein they are pneumatically driven both to effect the formation of the pixels and to cause the return of the marker pins to an operational ready position. This pneumatic return actuation technique achieves advantages in avoiding fatigue failure and in performing a clearing and lubricating function particularly useful in rigorous industrial environments. Movement of the marking pins is monitored pneumatically so that in the event of breakage or malfunctions thereof, error detection on the part of the control system for actuating the marking pins essentially is immediate.

As another aspect and object of the invention, the control system operating the marking pin array may provide a preliminary test procedure to assure proper message marking performance.

Another object of the invention is to provide a marking apparatus of the character described capable of publishing relatively extended messages having select character formations, for example, utilizing where desired italics or similar character form changes. Further in this regard, the angle of attack of the marker pin array may be altered to effect character height adjustment and marking may be carried out with selected alterations in the direction of movement between the array and the surface to be marked in essentially simple fashion.

Another object and feature of the invention is to provide apparatus for marking the surface of solid materials with predetermined character-defining information which includes a support structure situable in proximity to the material surface. A head arrangement is coupled with that support structure which includes a confronting surface which is positionable a predetermined distance from the surface of the material to be marked. The head incorporates an array of discrete chambers, each being configured having a piston receiving portion extending from a first chamber position toward a seating surface and having a shaft receiving portion extending to an opening at the confronting surface. A marker pin is positioned within each chamber of the array, each marker pin having a piston defining portion of predetermined length which extends from a top surface, a travel limiting surface and a shaft portion depending from the piston portion extending to a character component forming surface. The marker pins are pneumatically drivably movable from the first position wherein the top surface is adjacent the first chamber position to a second position wherein the travel limiting surface abutts the seating surface. The marker pins further are movable to a third position intermediate the first and second positions for effecting indenting contact with the surface of material to be marked. A drive conduit is provided in pneumatic communication with the chambers at a location adjacent the first position for selectively driving a marker pin toward the noted second position. A valve arrangement is provided which is actuable for selectively effecting the application and release of gas under drive pressure to the drive conduit and monitoring means in pneumatic communication with each chamber at outlets positioned adjacent to and blocked by the piston defining portion of the pins when they are moved between the first and third positions are provided. These outlets are unblocked by the piston defining portions of the marker pins when such pins are in the second position. A sensor is coupled in pneumatic communication with the marking conduit which has a predetermined output condition when an outlet is unblocked and return means are provided for moving the marker pin toward its first position. Additionally, a control circuit is provided for actuating the valve to derive a selected character formed by the impacting of the character component forming surfaces of the marker pin with the surface to be marked and is further responsive to the sensor output condition for deriving a signal representing of movement of the marker pin to its second position. This signal may be utilized to provide an error indication representing a broken pin or further may be utilized in carrying out testing both of the proper movement of the marker pins and the operation of the sensor.

Other objects of the invention will, in part, be obvious and will, in part, appear hereinafter.

The invention, accordingly, comprises the apparatus and system providing the construction, combination of elements and arrangement of parts which are exemplified in the following detailed disclosure. For a fuller understanding of the nature and objects of the invention, reference should be had to the following detailed description taken in connection with the accompanying drawings.

BRIEF DESCRIPTION OF THE DRAWINGS

FIG. 6 is a partial sectional view of three marker pin components and associated chambers of the apparatus of FIG. 1;

FIG. 11 is a schematic diagram of a control system which may be utilized in conjunction with the apparatus of FIG. 1;

DETAILED DESCRIPTION

The apparatus of the invention performs in conjunction with an array of steel marker pins which are slideably retained within a head assembly and pneumatically driven in programmed fashion into the surface of a rigid "imaged" material upon which a desired single or multiple character message is to be permanently recorded. Through a selective control over the array of marking pins, any of a wide variety of messages can be impressed upon the imaged material with a correspondingly relatively broad selection of character heights and formations.

Figure 1:
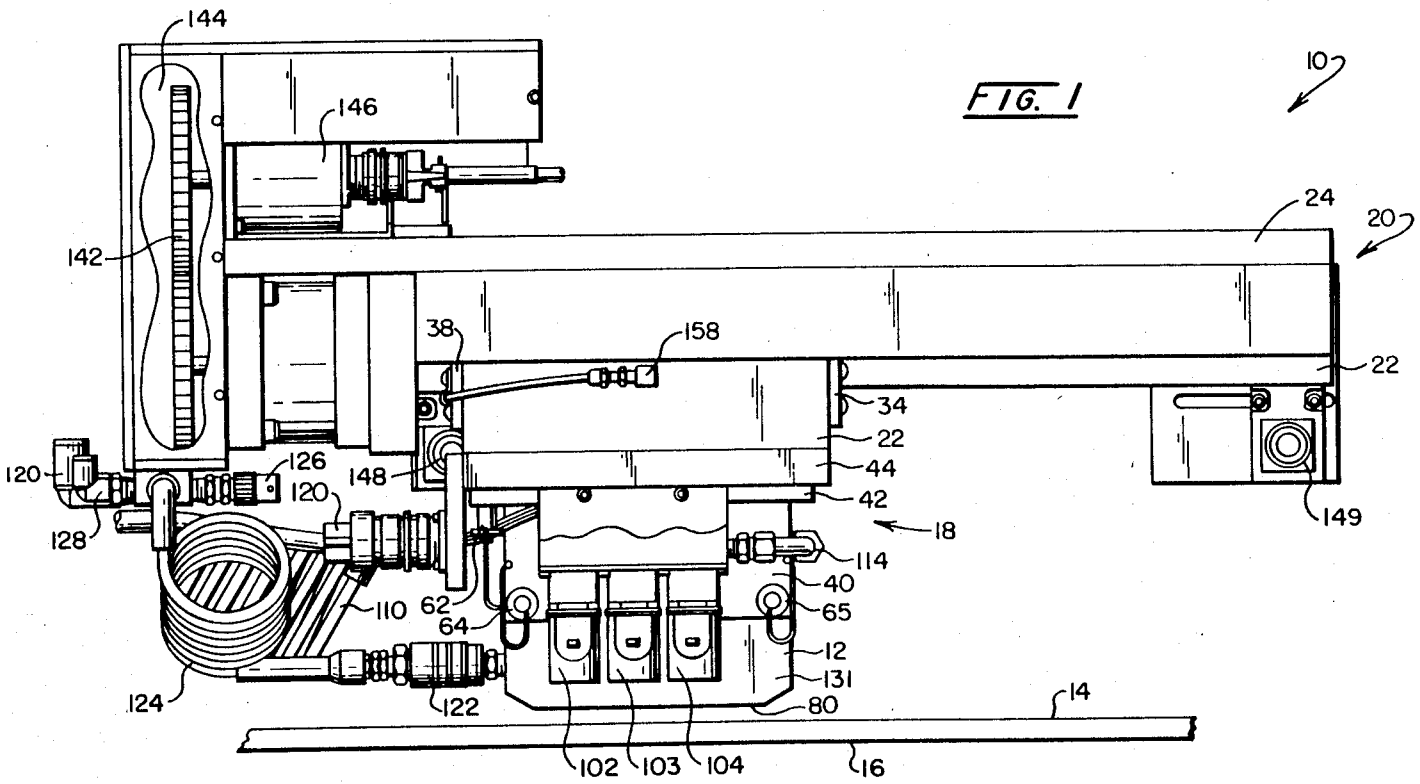
FIG. 1 is a side elevational view of apparatus according to the invention with portions broken away to reveal the internal structure.

Looking to FIG. 1, an embodiment of apparatus according to the invention wherein the head assembly is moved over the imaged material surface is represented generally at 10. Apparatus 10 is supported such that a head component 12 thereof is positioned a predetermined distance from the upwardly disposed surface 14 of an imaged material 16 which is retained in fixed position. Head component 12 carries an array (here, linear) of seven marking pins which are driven in preprogrammed fashion into surface 14 as the head component is moved along a linear locus of travel.

Head component 12 represents the lowermost portion of a carriage assembly represented generally at 18 which is slideably moved upon and is supported by an upper support structure represented generally at 20. The vertical position of head component 12 may be adjusted by providing a predetermined vertical positioning for the upper support portion 20. A movable association between the upper support 20 and carriage assembly 18 is developed through the use of an inverted dovetail slide assembly having a male portion assemblage 22 (FIG. 3) which, in turn, is supported by and depends from an upper support plate 24. Connection of the inverted dovetail component 22 with support plate 24 is revealed in FIG. 2 as being provided by machine screws 26.

Figure 3:
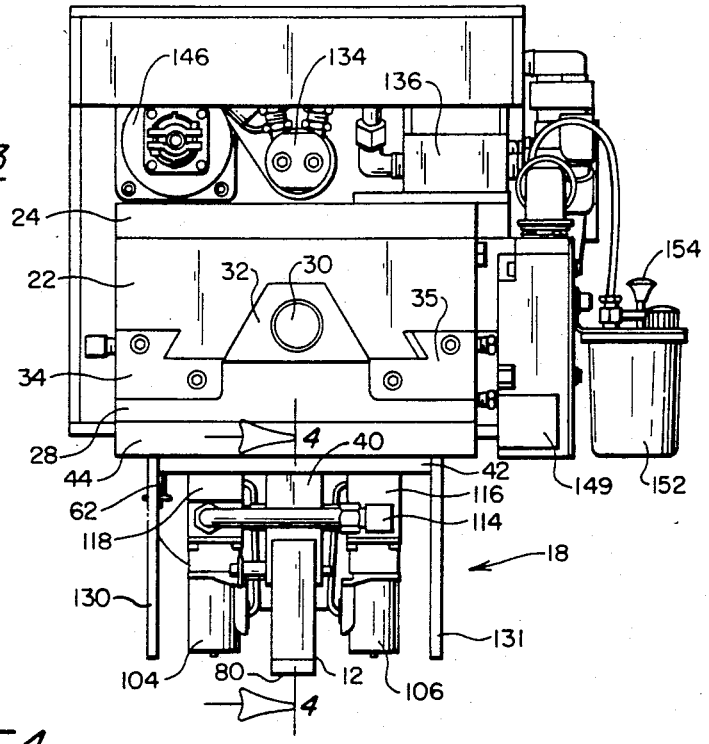
FIG. 3 is a front end view of the apparatus of FIG. 1.

Looking particularly to FIG. 3, the carriage assembly 18 is shown to further include a saddle component 28 which is configured to form a corresponding female dovetail slide arrangement cooperating with inverted dovetail slide 22. Controlled linear motion along the locus defined by the assembly of dovetail components 22 and 28 is provided by an elongate driven ball or lead screw 30 (FIG. 3) which is mounted in driving relationship with saddle 28 by connection therewith through extensions as at 32. To maintain the requisite cleanliness of the dovetail assemblage, neoprene seals or "way wipes" as at 34 and 35 are provided on the outboard end of saddle 28 and, as shown in FIG. 1, a similar arrangement is provided at the inboard portion thereof, one such seal being shown in the figure at 38.

Figure 4:
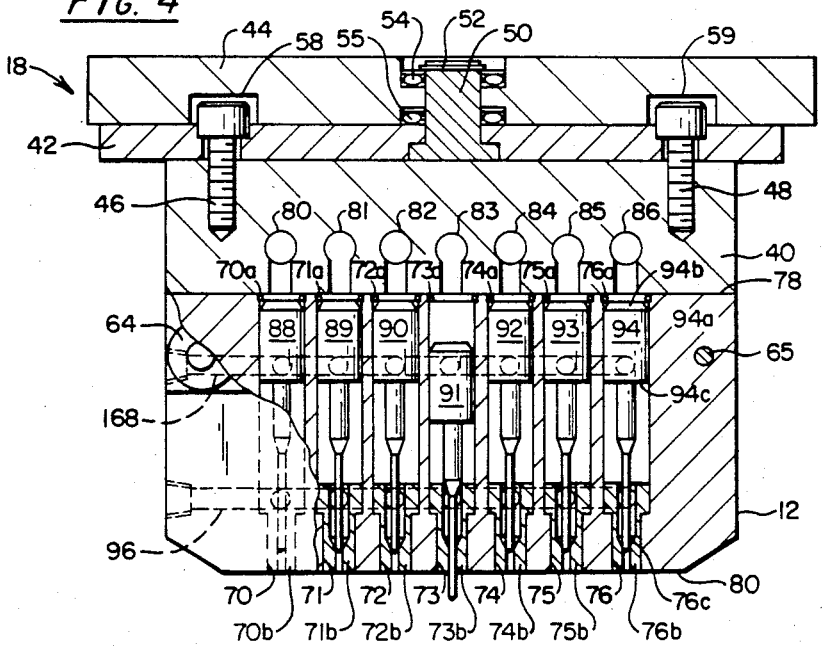
FIG. 4 is a partial sectional view of the apparatus of FIG. 3 taken through the plane 4—4 thereof.

FIGS. 1 and 3 further reveal that the head component 12 of carriage assembly 18 is nestably connected within a downwardly disposed slot of a head receiver 40. Receiver 40, in turn, is connected to the downwardly disposed surface of a lower mounting plate 42. As shown in FIG. 4, lower mounting plate 42 of carriage assembly 18 is, in turn, mounted for rotative adjustment upon a top mounting plate 44. The latter figure shows that the attachment of support 40 to lower mounting plate 42 is seen to be provided by machine screws 46 and 48, while the connection of plate 42 with plate 44 is provided by a pin or axle 50 extending through plates 44 and retained in position by a retainer ring 52. To permit accurate rotation of those portions of the carriage assembly 18 extending below top plate 44, pin 50 is laterally supported by thrust bearings 54 and 55 and the head portions of machine screws 46 and 48 are located within respective arcuate slots 58 and 59 formed within the underside of top mounting plate 44. With the arrangement, the angular orientation of the head component 12 with respect to any material to be marked as at 16 may be adjusted for the purpose of selecting character height and the like. To maintain the carriage assembly 18 in a selected angular orientation, the lower mounting plate 42 is locked into position with respect to upper mounting plate 44 by a ball lock pin 62 extending through apertures formed in the support plates. In general practice, the apertures through which pin 62 extends are selected in customized fashion for each application of the apparatus 10. Through the use of such ball lock pins as at 62, alteration of the angular orientation of head 12 readily are carried out by the operator.

FIGS. 1 and 4 further reveal that head component 12 is removably positioned within the slot of receiver 40 by similar ball lock pins 64 and 65. This arrangement permits fascile operator access to the marking pins which are located in a linear array within component 12. Referring to FIG. 4, the head component 12 is shown to be configured having a linear array of seven discrete marker pin chambers 70–76. Each of the chambers 70–76 extends between openings at the upper, access surface 78 and at the lower confronting surface 80 of head component 12. When head component 12 is assembled upon support 40 in the earlier-described nestable fashion, the annular openings at access surface 78 abutt against the corresponding lower surface of support 40 in alignment with a corresponding array of discrete conduits 80–86 which extend in select transverse directions through support 40 to provide pneumatic input ports. In this regard, the conduit 86 of the array is shown in sectional detail in FIG. 5. Of these conduits, the ports of conduits 81, 83 and 85 extend in one direction which may be considered outwardly from the drawing, while the ports of conduits 80, 82, 84 and 86 extend in an opposite direction, this arrangement being provided for the instant embodiment wherein pneumatic control is provided at the carriage assembly 18. The pneumatically secure association of each of the chambers 70–76 at access surface 78 is achieved by the provision of O-rings 70*a*–76*a* positioned at surface 78 and within appropriate grooves. These O-rings and the association between surface 78 and the lower abutting surface of support 40 provide, upon assembly, an abutting position for the uppermost surfaces of an array of marker or indenter pins 88–94.

Each of the marker pins 88–94 are formed of a relatively high strength steel, for example, a type M2 high speed tool steel having a hardness of RHC-65. To facilitate the description of the marker pins and associated chambers, the details of their structure are illustrated in enlarged fashion in FIG. 6 in conjunction with three chambers 70–72. Inasmuch as the structures of all these components are identical, their description is provided in conjunction with chamber 70 and marker pin 88, alphabetical suffixes being used to identify features common to all components. This same alphabetical identification is utilized, where appropriate, for the entire array of seven marker pins and associated chambers. Looking to FIG. 6, note that each marker pin as at 88 is structured having a piston portion 88*a* which extends between a chamfered upper abutting surface 88*b* and a lower return drive surface 88*c*. The piston portion 88*a* is configured having a diameter selected to achieve a sliding movement within chamber 70 to provide pneumatically actuated reciprocal drive to the marking pin arrangement. Extending integrally from the center of piston portion 88*a* is a cylindrical first stem portion 88*d* which, in turn, extends to a limit surface 88*e* serving to provide an abutting or travel restraining portion limiting the downward travel or throw of the marker pin. Extending from limit surface 88*e*, is a marker pin shaft 88*f* of lesser diameter than stem portion 88*d* which terminates in a conically shaped character component forming surface 88*g*. Surface 88*g* serves to form the discrete pixel or element forming a character of the message produced by the assembly 10.

Each of the chambers 70–76 is configured to retain a chamber insert extending to confronting surface 80 as shown at 70*b*–76*b*. In FIG. 6, it may be observed that the chamber inserts are configured having an upper flat abutting surface as at 70*c* and a lower, conically shaped seating surface as at 70*d*. Above surface 70*d*, the inserts as at 70*b* are configured to receive the corresponding marker pin stem portion as at 88*d* and 88*e*. The lowermost portion of each insert is formed having a lower bore 70*e* of diameter suited to receive the stem portions as at 88*f* of each marker pin in a slideable but somewhat pneumatically secure fashion.

FIG. 6 illustrates the general technique of actuation of the marker pins 88–94 in the course of operation of apparatus 10. In this regard, marker pin 88 is shown in an operational ready orientation wherein its abutting surface 88*b* is adjacent O-ring 70*a* at the upper access surface 78. The pin 88 is retained in this operational ready position by virtue of a return pneumatic pressure introduced through a return conduit 96 which is coupled pneumatically in parallel to the lower regions of all chambers 70–76. Thus introduced, this pneumatic pressure enters a somewhat pressure secure region identified between the return drive surface 88*c* and the seal between stem portion 88*f* and the lower bore 70*e* of chamber insert 70*b*. The pressure provided from the return conduit 96 is selected such that it may be overcome by a marker pin pneumatic drive force emanating from conduits 80–86 but remains of sufficient value to achieve a quick recovery to the operational ready position represented by pin 88 following a character forming operation. For the generally encountered industrial applications, a return pressure between about 15 and 60 psig is desirable, a pressure of 20 psig generally being selected. The election of particular pressure values is premised upon the pneumatic pressure sources conventionally available in an industrial environment. It should be understood that return gas input to the chambers also can be provided individually or serially.

As noted above, to provide a marking actuation, a higher drive pressure is introduced from along conduits 80–86 to overcome the return pressure and drive the character forming surface 88*g* into contact with the imaged surface 14. Generally a drive pressure of about 90 psi is available at input conduits 80–86. FIG. 6 shows the marking orientation of pin 89 wherein a pixel or character component is formed within surface 14 of material 16 as represented at 98. The surface 89*g* is of conical shape and the amount of drive provided by the system is such that the character component forming surface 89*g* will not fully penetrate surface 14. For low stress applications a spherical or rounded component forming surface may be provided as at 89*g*. Should such full penetration would be permitted, an undesirable material flow is evidenced around the formed pixel. Note additionally, that the marker pin 89 does not travel its full available throw distance to provide the character pixel 98. However, in the event of a broken marker pin shaft portion as represented at 90*f* or in the event of a later described test procedure, then the marker pin will seat against the associated insert as shown. Note in this regard, that return drive surface 90*c* is abutting against upper surface 72*c* of insert 72*b*, while the seating surface 90*e* is in abutting adjacency with corresponding seating surface 72*d*. Preferably, contact is made between surfaces 90*c* and 72*c* just before a lower seating would occur.

The use of a return arrangement wherein pneumatic pressure is supplied through return conduit 96 achieves considerable advantage in the reliability of the operation of apparatus 10. In this regard, no fatigue otherwise encountered with return springs and the like is encountered and the smaller but positive pressure introduced from conduit 96 serves to provide a form self-cleaning of the marker pin-chamber array, an aspect quite valuable in an industrial environment. Further in this regard, inasmuch as the pressurized air providing return pressure will carry a small amount of lubricant, a lubricating function additionally is continuously asserted at the lower regions of the marker pin environment. Further, an advantageous cooling effect is achieved in the region of all orifaces due to the sudden expansion of the lubricated gas with respect to all openings to atmosphere. To achieve proper and reliable performance utilizing the return air pressure, however, it has been necessary to provide a pressure limit valve in conjunction with return conduit 96. In this regard, a valve is provided as described later herein which will vent pressures above the elected return pressure, for example, at 20 psig. Through such pressure limit valving, where two or more marker pins are actuated simultaneously, the resultant sudden return pressure build-up is accommodated for to provide for consistent marking performance.

Figure 7:
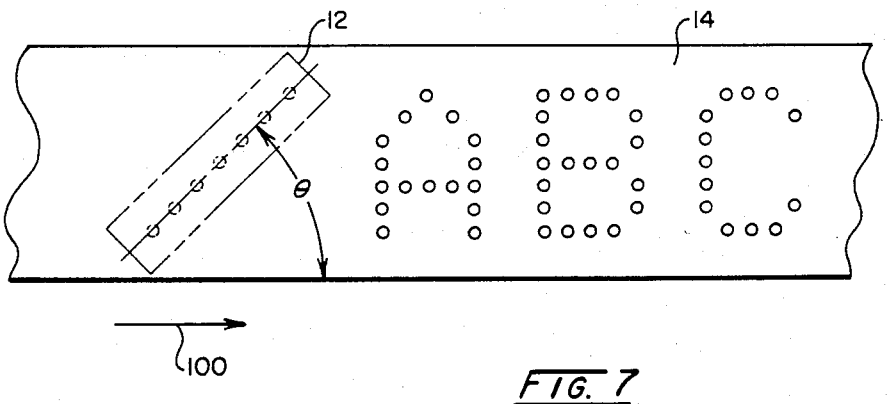
FIG. 7 is a schematic representation of a marker pin array and exemplary characters formed thereby.

With the linear array of seven marker pins 88–94, a broad variety of characters may be formed, for example, utilizing a 5×7 dot matrix character formation. Looking to FIG. 7, a schematic portrayal of the head component 12 and linear array of marker pins is shown in conjunction with the letters "ABC" formed in dot matrix fashion. To provide these characters, the head 12 is moved in the skew orientation shown, for example, in the direction of arrow 100. As the head 12 progresses, selected ones of the marker pins are actuated to create pixels defining the characters. By creating character components or pixels in the appropriate locations represented by the 35 available locations of the matrix, letters (A to Z), numbers (0 to 9) and other symbols such as comma (,), period (.) and the like can be formed. The approach permits generation of the full upper case ASCII character set. The schematic representation of head 12 is shown in the figure as being positioned at an angle $\theta$ with respect to the locus of travel thereof as represented by arrow 100. As is apparent, by altering the value of this angle, the height of the characters can be varied. It may be recalled from the discourse above in conjunction with FIG. 4, this angle $\theta$ readily is adjusted by the rotation of the head assembly about axle 50 and in conjunction with the utilization of ball lock 62.

Figure 2:
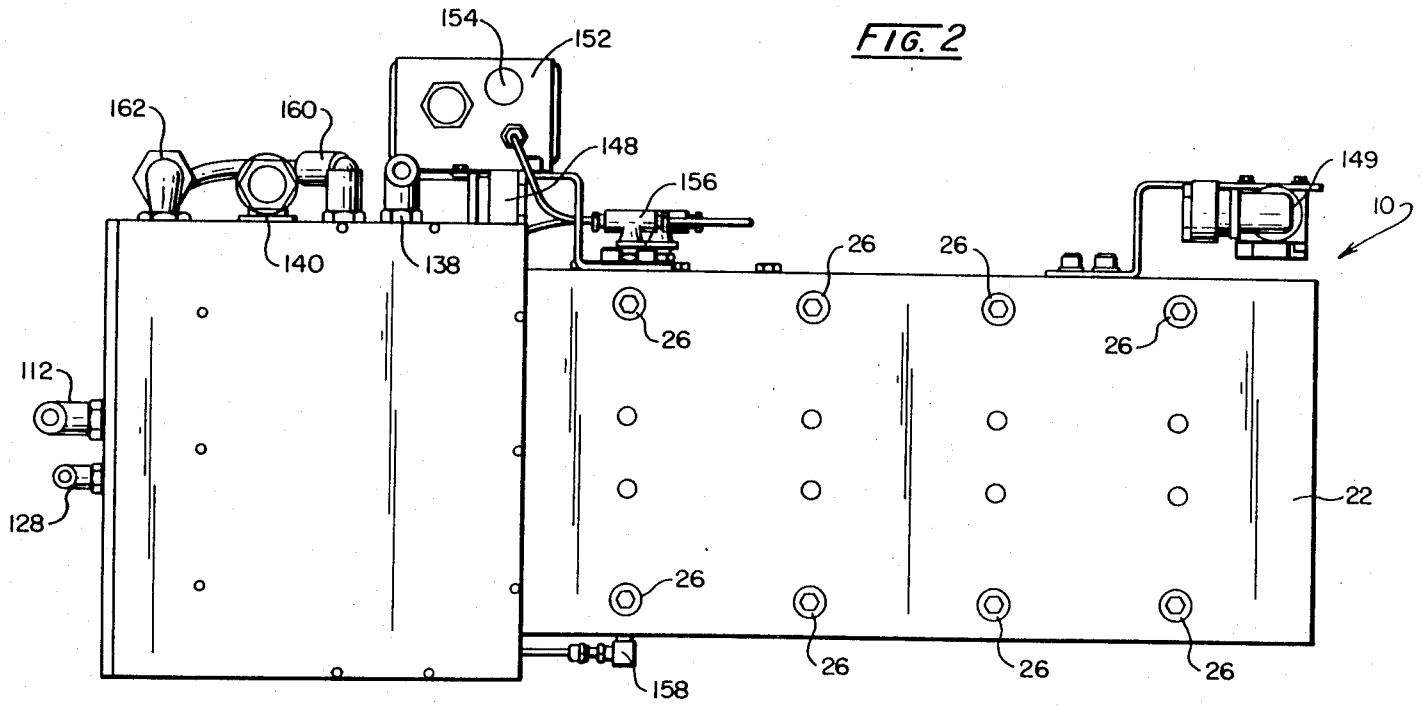
FIG. 2 is a top view of the apparatus shown in FIG. 1.
Figure 5:
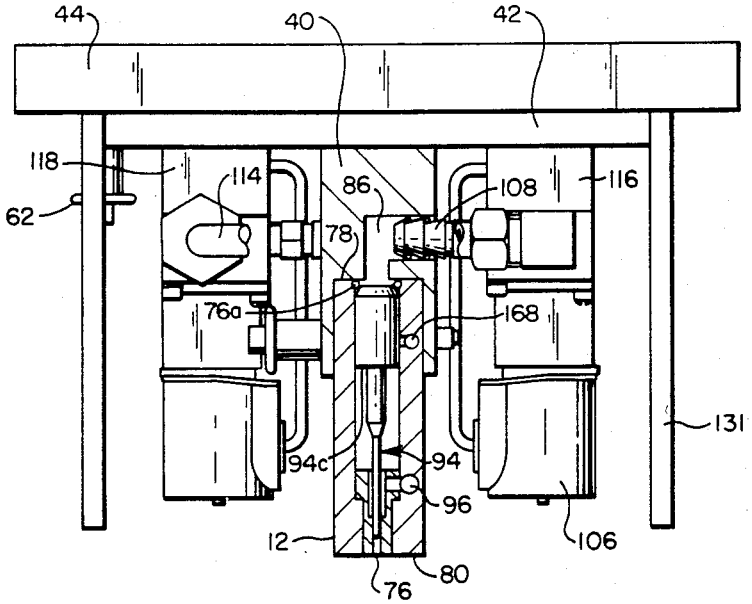
FIG. 5 is a partial sectional view of a marker pin and chamber structure of the apparatus of FIG. 1.

The actuation of the marker pins through high pressure input conduits 80–86 is controlled for each chamber by a solenoid actuated valve arrangement. FIG. 1 shows three of the solenoid-valve combinations as are associated with conduits 80, 82 and 86, respectively, at 102–104. A similar array of four solenoid actuated valves is provided on the opposite side of carriage 18, the forwardmost such valve being shown in FIG. 5 at 106 as operatively associated with chamber 86. The solenoid actuated valves selected are of a normally closed, three-way variety and the valve arrays on either side of the head 12 readily are connected or disconnected by a barb and ring coupling, one of which is shown in FIG. 5 in sectional detail at 108. High pressure air is supplied to the controlling valves from a common manifold which, as shown in FIG. 1, is supplied from a flexible high pressure conduit 110. FIGS. 1 and 2 show the connection input to this flexible conduit at 112. The common high pressure connection between the manifold for the solenoid-actuated valves on either side of head 12 is shown in FIGS. 1, 3 and 5 at 114 and the electrical input to each of the solenoids is provided from wire race conduits shown in FIGS. 3 and 5 at 116 and 118. Electrical connection to the wiring in these wire races is provided by a connection shown at 120 in FIG. 1. FIG. 1 also shows the source connection for providing the return pneumatic pressure at conduit 108. In this regard, a quick disconnect form of connector 112 is coupled to head 12 which, in turn, leads through flexible coiled tubing 124 to a pressure relief valve 126 and supply input coupling 128. The entire head assembly along with the solenoid actuated valves are protected by metal plates 130–131. For the most rigorous of industrial or mill environments, the electrically actuated valving may be positioned remotely from head 12.

Traversing drive imparted to the carriage assembly 18 through the ball screw arrangement as described at 30 and 32 in conjunction with FIG. 3 is provided by a bidirectional air motor shown in that figure at 134. The direction of operation of air motor 134 is selected by a directional solenoid actuated valve arrangement shown at 136. The high pressure input to the valve 136 is provided through a coupling shown in FIG. 2 at 138, while the electrical connection to the solenoid components of the valve assembly 136 are provided at coupling 140. The drive output of motor 134 is directed, as shown in FIG. 1 to a gear train 142 which is situated within a sealed gear enclosure or chamber 144. This gear drive also serves to drive an optical encoder which is shown at 146 in FIG. 3. Encoder 146 provides a pulse categorized form of output signal representing the head output position. The limits of movement of carriage assembly 18 are detected by spaced proximity detectors shown in FIG. 1 at 148 and 149. Looking to FIGS. 2 and 3, an arrangement for lubricating the moving components including the ball drive 30 is revealed as a reservoir 152, the fluid lubricant within which is maintained under pressure by a hand pump 154. FIG. 2 reveals a portion of the lubricant distribution as including connectors 156 and 158. FIG. 2 also shows a connection 160 providing for the diverting of exhaust from the directional solenoid 136 combination into the chamber 144. Not shown is a similar conduction of exhaust air from motor 134 into chamber 144. This lubricant carrying exhaust air provides a positive pressure within chamber 144 to achieve a form of self-cleaning and lubrication of the components therewithin. The outlet from chamber 144 is shown in FIG. 2 as a muffler 162. As noted earlier, the provision of a positive pressure within the gearing and mechanical components of the apparatus 10 serves to avoid contamination generally encountered in the rigorous environment with which apparatus 10 may be utilized.

Returning to FIG. 6, it may be observed that in the course of a typical actuation of a marker pin from the operationally ready orientation shown in conjunction with pin 88 to the position of impact with surface 14 as represented by marker pin 89, a variety of dynamic aspects are encountered. For example, at the point in time where the control circuit for apparatus 10 determines that a pixel or dot is to be impressed in surface 14, a signal must be sent to the appropriate solenoid actuated valve to cause it to open. Typically, such solenoid valves require about 12 msec to fully open. The high pressure air introduced from a conduit as at 80–86 must then overcome the controlled return air pressure as monitored at conduit 96 and the marker pin then is caused to accelerate throughout its travel toward the material 16. At some point during this activity, the pertinent solenoid actuated valve must then close and allow the high driving pressure air to vent as the marker pin is returned by the return air towards its operational ready position. Generally, where the required depth of impression caused by the character forming surface of the marker pin is relatively deep, then the traversing mechanism or carriage 18 (FIG. 1) will be stopped to accommodate for the longer interval of marking required. For this arrangement, generally, there is a delay following which the solenoid actuated valve is opened. The delay continues to allow the marker pin to withdraw before the carriage 18 is moved to a next pixel forming position.

Because of the noted rigorous environment within which apparatus generally is employed, it may be expected that from time to time the lower stem portion of the marker pins may be broken as illustrated at 90*f* (FIG. 6). Additionally, a situation may be encountered wherein a material as at 16 is not properly positioned such that no contact would be made between the character component forming surface as at 89*g* and the surface of such material and the marker pin will assume its fully extended orientation as shown in FIG. 6 at 90. Such malfunctioning conditions are monitored with the instant apparatus through the use of a pressure responsive transducer represented schematically at 166 which is coupled to a manifold duct 168 which interacts in parallel with all chambers 70–76. Of course communication with the chambers 70–76 may be in series or individually for this monitoring function also. As shown in FIG. 6, however, the duct 168 is positioned for such interaction such that during normal operation no pressure will be sensed by transducer 166 other than the small amount of "blow by" pressure which can be accommodated for and expected. The normal dynamic movement of the piston portions of the marker pins is shown at 88*a* and 89*b*. During such normal reciprocative performance, note that the access outlet of duct 168 as shown at 168*a* is covered by piston portion 88*a* for the operational ready extreme position. Similarly, as the marker pins are driven into their full operational downward position contacting surface 14, the piston portion as shown for this orientation 89*a* still covers the outlets of duct 168 as shown at 168*b*. Accordingly, no pressure type signal will be sensed by transducer 166 for normal reciprocative movement of the marker pins. However, should the stem portion as at 90*f* of a marker pin be broken as shown in FIG. 6, then the corresponding piston portion of the marker pin as represented at 90*a* will move downwardly, for example to a fully seated position such that the outlet as at 168*c* of duct 168 will be exposed to the actuating drive pressure emanating from conduit 82 and that pressure will be recognized by transducer 166 to provide a signal. This signal may be utilized to alert the operator as well as bring the apparatus 10 to a halt. This same type of signal also can be used for carrying out tests of the marker pin movements by moving the carriage 18 away from material 16 and testing each of the marker pins 88–94 for full reciprocative movement into their seated positions. The program for carrying out such testing is described later herein.

Figure 8:
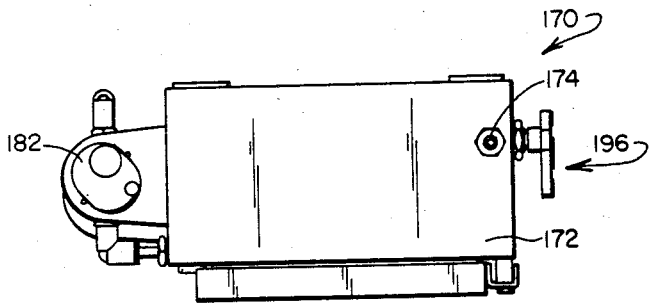
FIG. 8 is a top view of an air regulator cabinet used with the apparatus of FIG. 1.
Figure 9:
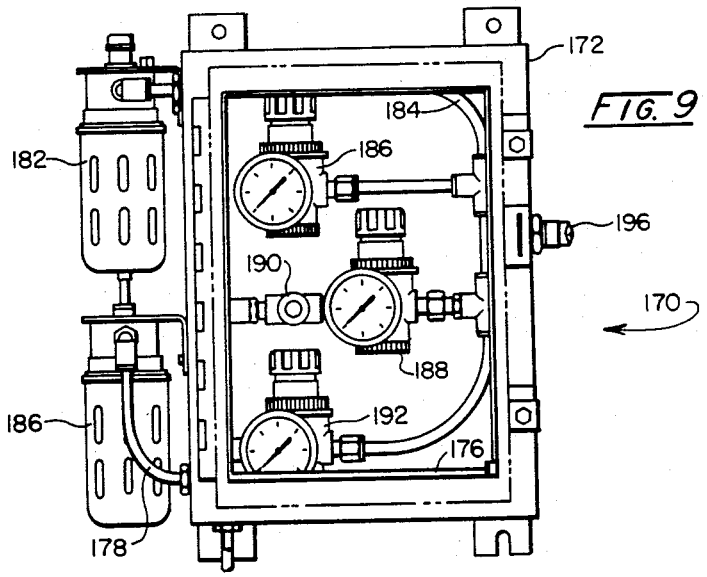
FIG. 9 is a front view of the cabinet of FIG. 8.
Figure 10:
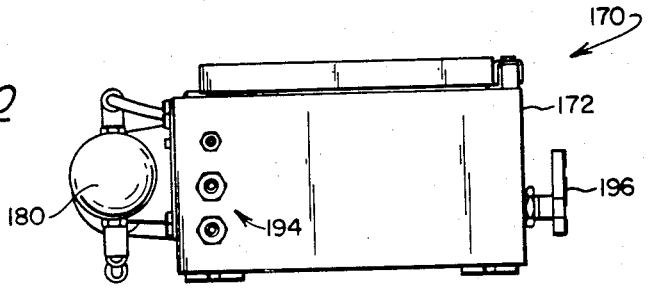
FIG. 10 is a bottom view of the cabinet shown in FIG. 8.

Referring to FIGS. 8–10, the air regulating components associated with apparatus 10 are revealed generally at 170. It may be recalled that these components serve to provide two levels of air pressure for both the operation of the marker pins utilizing two select pressure levels and for the driving of air motor 134. The lubricated quality of the air utilized also serves the earlier noted lubrication function within the chambers 70–76 and provides a positive pressure within the gear containing chamber 144. In conventional fashion, the air regulator components 170 are assembled within a protective cabinet 172 which receives a basic pressurized air input at coupling 174. From coupling 174, the air from a given industrial source under pressure is introduced into cabinet 172 through a conduit arrangement positioned about the interior periphery thereof, one portion of which is shown at 176. Conduit 176 extends outwardly of cabinet 172 as represented at 178 which leads to the input of an air filter 180. From filter 180, lubricant is added thereto at lubricator 182. Upon being filtered and lubricated, the air then is directed through conduit 184 to branch to three regulation stages. The initial one of these stages is provided as a gauge containing regulator 186 which provides a selected drive pressure for the actuation of marker pins 88–94 as represented at 186. Generally, this pressure is set at between 100 and 120 psi depending upon available pressure sources and the extent or size of the character components to be formed. Conduit 184 additionally leads to a head velocity regulating stage which includes a regulator, a gauge and a flow control arrangement, the latter being shown at 190. The output of stage 188 and control 190 is directed to air motor 134 through directional solenoid 136. Finally, the return air input is regulated by regulator and gauge assembly 192. The above-described three regulated outputs are then introduced to apparatus 10 as earlier described in conjunction with input connectors 112, 128 and 138 (FIG. 2) from corresponding output connectors at the bottom of cabinet 172 as represented generally at 194. A manual on/off control for the entire arrangement 170 is provided at 196 extending from cabinet 172.

Referring to FIG. 11, a schematic representation of the control circuit utilized in conjunction with apparatus 10 is provided. Where appropriate, the elements of apparatus 10 discussed in detail hereinabove are shown in block form with the same identifying numeration.

The control apparatus 10 may be accessed from a general computer facility and/or through an operator terminal. This approach is represented in the figure by respective blocks 202 and 204. Generally, input to the microprocessor components of the control system as represented at block 206 is provided in conventional serial fashion through the utilization of RS232 interfacing. Of course other interfacing may be employed. An operational relationship between the host facilty at block 202 and the terminal at block 204 is represented by line 208, while direct access of either of these functions with the microprocessor system is represented by lines 210 and 212. The microprocessor system represented at block 206 may be formed of conventional components, for example, the processing function may be provided as an ISB3111 is marketed by the Intersil Systems of General Electric Co., Sunnyvale, Calif. This type of processor arrangement utilizes a type 8085 microprocessor running at 4 MHz and utilizes type 8532 random access memory of 4K capacity as well as a 16K EPROM instructional storage capacity, for example of a type 2732. The processing arrangement further will include a type 8253 counter-timer which is utilized for the purpose of developing periodic interrupt signals as a consequence of treating the output of encoder 146. In this regard, it may be observed that the output of encoder 146 is represented at line 214 as extending through a signal conditioner represented at block 216 which may be considered to include a buffer function, for example type 74LS244. The serial input of character data as represented at lines 210 and 212 to the microprocessor function 206 may be provided through utilization of, for example, a dual channeled synchronous-/asynchronous communications circuit marketed as a type ISB3700 by Intersil Systems (supra). Such a circuit arrangement provides for two, RS232 20ma current loop input/output ports which are programmable for baud rate and format. In conventional fashion, communication between the processor components as represented at block 206 and external inputs may be provided through input/output networks, for example, a type 7605 programmable TTL input/output network marketed by PRO-Log Corporation of Monterey, Calif. This input/output network is associated with input/output buffers as represented at block 218. The inputs to the input/output function of the control circuit will include such switch selected data as the number of spacings between pixels character forming which is developed by the type of division carried out in conjunction with the input from encoder 146, the interval of energization of the solenoid driven valves and other such data. In particular, the input buffers represented at block 218 provide directional drive data from along lines 220 and 221 to motor directional drive solenoid 136. Drive to the solenoid actuated valves associated with head 12 is provided by a driver function which will include a power supply of appropriate voltage level and communication with the individual solenoid valves is represented by line 200. Additionally, the output of limit switch 148 is directed to the buffering function 218 as represented at line 224, while the corresponding input from limit switch 149 is provided from line 230. Further, the condition of transducer 166, for example, representing a marker pin breakage, is submitted from along line 226 to a comparator represented at block 228 for inputting to the buffers at function 218. The comparator function 228 provides a threshold detection arrangement such that a predetermined pressure level change as detected at transducer 166 may be converted to a signal level which can be received at buffer function 218. A ready indicator lamp is shown at 232 in communication with the buffer function at block 218 through line 234. The head 12 may be operated traversing in either direction or in stationary fashion while material 16 moves depending upon the design desires of the user. For commencing a test sequence, a switch arrangement may be provided as at 236 communicating with the buffers through line 238. Additionally, where desired, a print command signal may be generated to automatically commence a message forming sequence through the use of position detector switches or the like as represented generally at 240. The output of such detection devices is shown appropriately inputted to the buffer function at block 218 via line 242.

Figure 12:
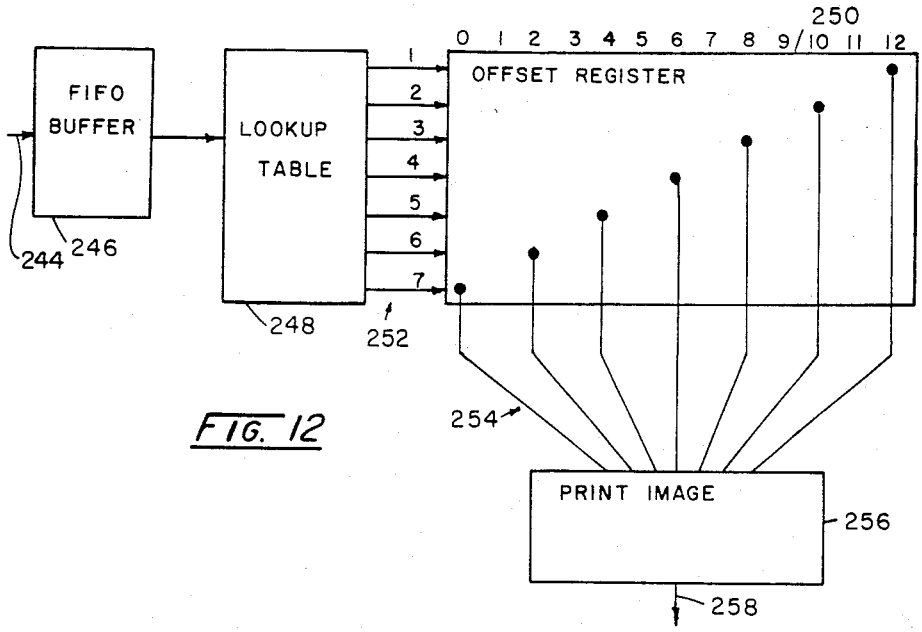
FIG. 12 is a schematic representation of control functions utilized in conjunction with the control system shown in FIG. 11.

Generally, a message to be formed upon surface 14 is received in serial data form utilizing an ASCII format in which serialized data are then converted to multi-bit parallel format by the earlier-described input/output network. The message generally will show an end position through the use of a symbol such as a carriage return (CR) and will be accompanied by a print command signal. Turning to FIG. 12, the technique utilized to accommodate for the skew arrangement of head 12 as described in conjunction with FIG. 7 as angle $\theta$ is illustrated in general fashion. Additionally, inasmuch as apparatus such as at 10 may be operated in either direction or in conjunction with moving material 16, the technique for message storage is represented in this figure. The ASCII message is represented at input arrow 244 as being directed to a FIFO buffer represented at block 246. This is a first-in/first-out buffer developed in RAM which is of sufficient capability to hold the largest message which it is desired to produce. As each character is received it is stored in the buffer function until a conversion to usable format occurs. The conversion process is commenced with the accessing a given ASCII character in a ROM containing look-up table as represented at block 248. The table represented at block 248 normally has eight, one-byte memory locations for each character which would be provided in the ASCII message. For example, for the full upper case ASCII character set, this would require 512 memory locations. Were head 12 constrained to operate only in a perpendicular orientation to the message being printed, then the output of the function represented at block 248 could be utilized to develop actuating signals for the marker pin array of head 12. However, to accommodate the noted desirable skew angle, an offset delay function may be provided, for example, in the form of a 12 byte offset register as represented at block 250. The parallel data input to the delay function 250 is provided as represented by seven-line array 252 and the output thereof is tapped in sequential offset fashion by array 254 in correspondence with the elected skew angle $\theta$. The resultant information then is submitted to a storage table or the like in RAM represented at block 256 and the latter memory function may then be accessed essentially from either side for input to the driver function 198.

The elected directional output of the RAM retained storage table represented at block 256 is provided as a parallel output represented as arrow 258. Thus, with the arrangement shown, the information at buffer function 256 provided in RAM is converted to a solenoid valve actuation select signal which then is selectively offset in correspondence with the skew orientation of head 12.

The transfer of signals from the aligning function 250 into the message image storage memory function 256 is carried out in synchronization with the output of the encoder 146 as appropriately divided by the microprocessor system divider function described in conjunction with block 206. Generally in considering the pixel spacing involved, it is important that integer relationships exist between marker pin spacings and the pixel or component spacing forming each character. This permits a facile digital processing of data. By selectively adjusting the division of encoder input pulses, the letter characters also may themselves be slanted such that a capability exists for the system to create what, in effect, is an italicized character component. Of course, such division adjustment can be arranged so that the degree of angularity and direction of slew can be varied.

Figure 13:
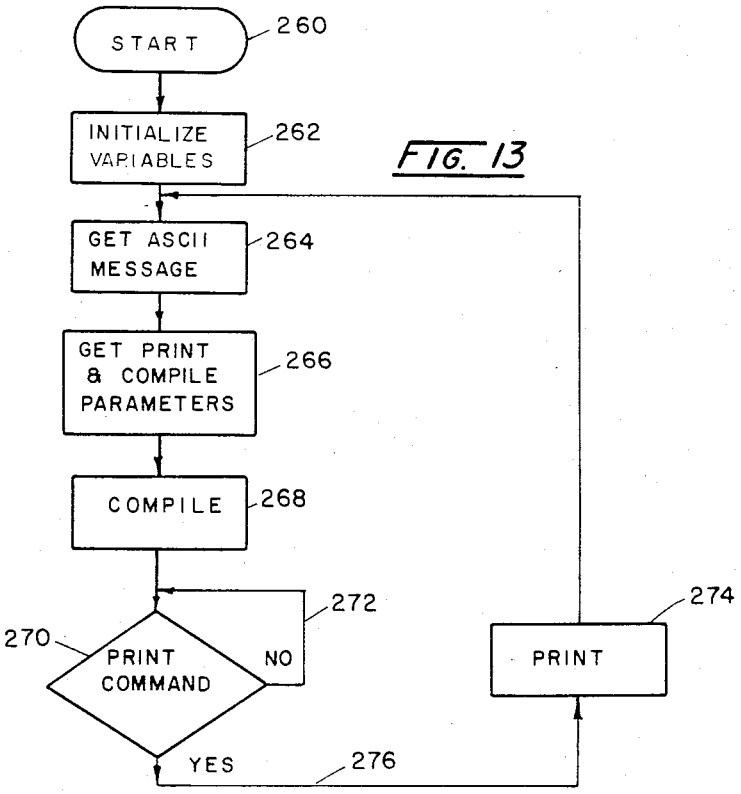
FIG. 13 is a flow diagram describing the overall program under which the control system of FIG. 11 performs.

Turning to FIG. 13, a general flow diagram describing the instructions under which the microprocessor system 206 performs. Following a program start as represented at block 260, initialization procedures are carried out as represented at block 262. Upon such initialization, as represented at block 264, the ASCII message is procured, for example, from the RAM provided buffering function described in conjunction with block 246. Upon procuring the message, as represented at block 266, the parameters for printing and compiling the message are procured, such parameters being evolved from the earlier-described switching inputs and the like. With these parameters procured, as represented at block 268, a compilation subroutine is carried out wherein the offset function as represented at block 260 is carried out and the data are appropriately treated for submittal to temporary memory generally referred to as "image" memory. As represented at block 270, the program then awaits a print command, whether derived from the operator, a host computer or sensing device. In the event that the print command has not been received, the program loops as represented by loop line 272 until such command is received. Upon receipt of the command, the program then enters a printing or publication function as represented by block 274 wherein the marker pin array is actuated to carry out publication of the message. It may be recalled that the acutation of the solenoid valves for causing pixel formation is in conjunction with a selectively divided output signal from the encoder 146. In practice, the interrupt function of the microprocessor is utilized for receipt of these clocking signals. The print routine also will be affected by any signals aborting a message or representing a pin failure or, for example, the output of a limit switch as at 148 or 149 showing an end of traverse. Following the carrying out of printing, as represented at loop line 276 the program acquires a next ASCII message as represented at block 264.

Figure 14A:
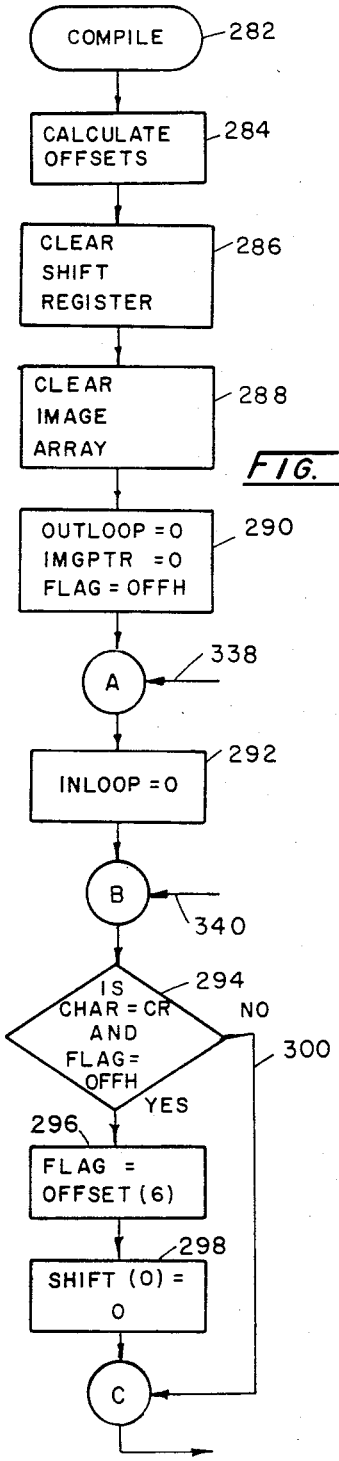
FIGS. 14A–14C are a flow diagram describing an image complier routine employed in conjunction with the control system of FIG. 11.
Figure 14B:
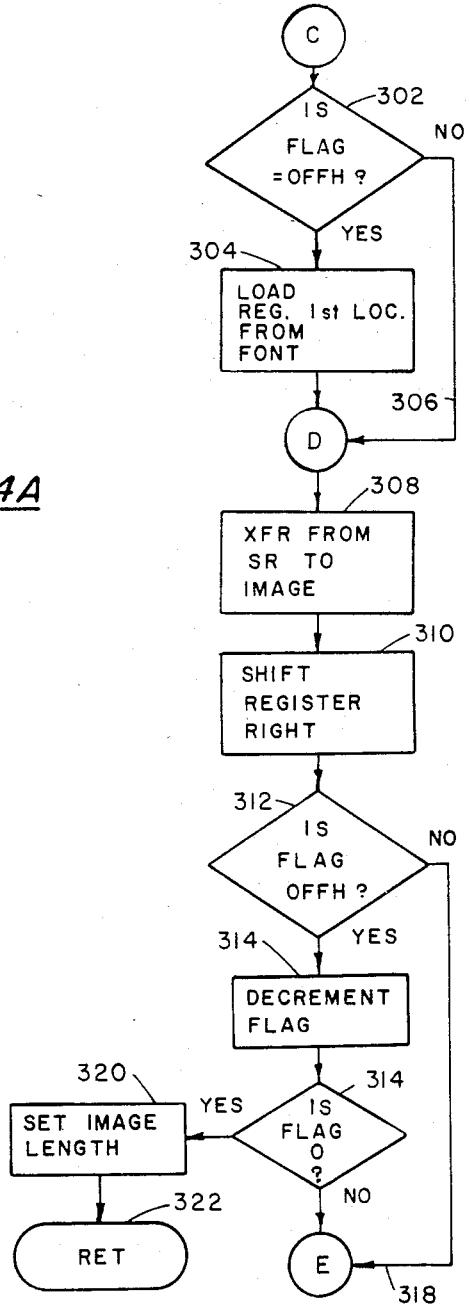
Figure 14C:
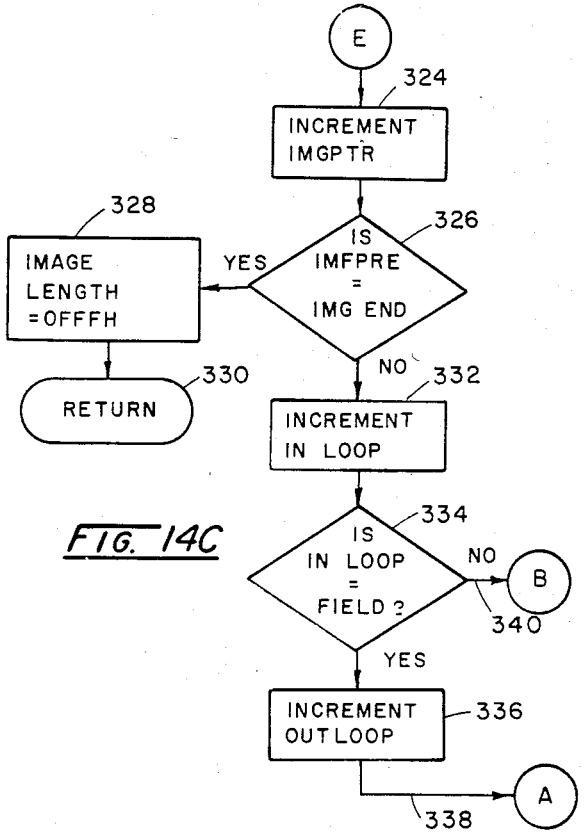

Referring to FIGS. 14A–C, the compile subroutine discussed in conjunction with block 268 is revealed in an enhanced level of detail. This subroutine serves to convert an operator or host computer entered message to the image data which are stored in random access memory and from which printing intructions are removed. Recall that this memory function is described in conjunction with block 256 in FIG. 12. A compile routine treatment and submission of the data to the image storage function are done for a complete message before printing takes place, thus, as indicated earlier, the message may be withdrawn from memory for printing purposes from either side of the memory, thus making the direction of traverse of carriage 18 optional with the operator. The compile routine is shown entered at block 282 and as the routine is entered, an address is received from the calling routine which points to a block of data showing the commencement of the ASCII message, storage position for the image array within RAM, the size of memory available, the integer value for pixel spacing and field data. In the latter regard, the field information is a single byte indicating the width of a character and the number of spaces elected between individual characters. Generally, for a $5\times7$ matrix, the width will be five pixel locations plus a character spacing or the value, six. Where small letters are used, however, for example, an "i" a smaller field may be programmed. The information collected also includes a pointer to a font table. In this regard, the font table has been described as the image look-up table represented at block 248 in FIG. 12. Of course, other data may be accessed depending upon the particular function of marking desired. The compile routine then progresses to the instructions at block 284 wherein the offsets as developed in conjunction with register function 250 are calculated. This calculation looks to the integer pixel spacing, for example, for a pixel integer count of 3, the register locations may be at integers 0, 3, 6, 9 etc. Generally, seven offsets are utilized for the noted $5\times7$ matrix. The subroutine then progresses to the instructions represented at block 286 at which position directions are provided for clearing the offset register 250 to assure that no spurious signals are present therein. Next, as represented at block 288, the image array or data stored for transfer to the print-head as described in conjunction with block 256 are cleared. Following the above, as represented at block 290, an outloop counter is initialized at a zero value, an image pointer is similarly positioned to show the location for storage in image memory and a flag is set to a value OFFH which is utilized to provide termination information. The outloop function is executed for every character in the ASCII message as well as for a predetermined number of times following a message to assure clearance of the register function 250. In effect, the outloop functions to identify the character and message being decoded and is utilized in calculations to determine where data are to be stored in image memory.

Upon completing the above initialization procedures, as represented at block 292, a next count or pointer function identified as "inloop" is initialized at a zero value. The inloop variable increments to identify the pixel components of a given character, as opposed to the outloop function of monitoring actual character presenttion. Accordingly, the routine looks to the query represented at block 294 wherein a determination is made as to whether a carriage return has been received representing an end of message and further, whether the above discussed flag representing a message termination retains the inserted value of OFFH. In the event that the conditions so represented are true, then the message is at an end and the routine progresses to block 296 wherein the offset value for the register function 250 is set to show the extent of the register function actually being utilized. Additionally, as represented at block 298, the zero location of the register is set at zero. In the event the condition presented at block 294 is negative, then, as represented by loop line 300 leading to node C the program considers the condition posed at block 302. Looking to FIG. 14B, and node C, block 302 inquires as to whether the flag value remains at zero FFH and in the event that it does remain at that value, then the message is not ended. Accordingly, as represented at block 304, the first location in the register function as represented at block 250 is loaded from the font or image look-up table as represented at block 248. In the event of a negative response to the query at block 302 as represented at line 306 and node D, or following the loading of the register function first location, the program then transfers the data from the register's function 250 to image memory as represented at block 308. Following such transfer, the register function is shifted to the next higher level as represented at block 310. Following this data maneuver, as represented at block 312 a determination is made as to whether the message continues by examining whether the flag value is less than OFFH. If that is the case, then as represented at block 314, the flag is decremented by one value and, as represented at block 316, a determination is made as to whether the flag value has reached zero. Where the inquiry at block 312 results in a negative response, then a message continuation is indicated and the program advances as represented at line 318 leading to node E. Where the inquiry at block 316 is in the affirmative, then a carriage return or the like will have been received by the system and the routine is exited. However, as represented at block 320, an indication as to the extent of the image memory utilized is established as represented by the instructions to set the image length. From block 320, the program returns to the calling program as represented at block 322.

Where the flag value is not zero or the flag value is not less than OFFH, then, as represented at block 324 in FIG. 14C, the pointer for the image memory as represented at block 256 is incremented by 1 such that it now points to the next location in image memory. From block 324, the routine progresses to the query at block 326 at which position, a determination is made as to whether the image pointer is at the end of image memory. If so, a message will have been compiled which is of greater extent than memory capacity. Accordingly, as represented at block 328, a very large image length is set and the routine returns to the calling program as represented at block 330. Where the inquiry at block 326 shows a negative response, then as represented at block 332, the inloop counter is incremented by a value of one. The routine then inquires as represented at block 334 as to whether the inloop valuation is equivalent to the field value, the latter representing the length of the character being treated. In the event that an equivalence is present, the last location for a given character will have been accessed and as represented at block 336 the outer loop is incremented and as represented at line 338 and node A in FIG. 14A, the program returns to block 292. Where the inquiry at block 334 results in a negative response, then the interloop condition is continuing and as represented at line 340, the program returns to node B and block 294 as shown in FIG. 14A.

Referring to FIGS. 15A–D, the print routine as discussed generally in conjunction with block 274 is set out in enhanced detail. This routine is shown to be entered as terminal 350 from which position an initialization procedure is carried out which determines essentially the number of repetitions which are to be made of a given message. Initially, however, as represented at block 352, the divider function described above for dividing the pulse output of encoder 146 is set to a desired value. It may be recalled that this division function may be programmable and the degree of division carried out may be varied depending upon the type of characters which it is desired to publish.

Figure 15C:
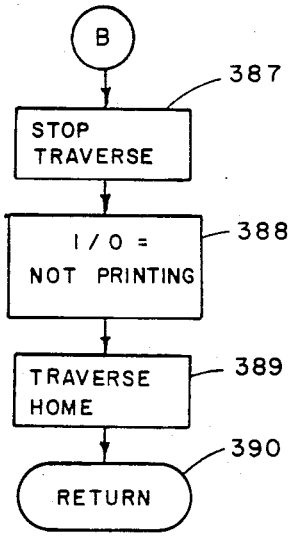
FIGS. 15A–15D are a flow diagram of a print routine utilized in conjunction with the control system of FIG. 11.
Figure 15A:
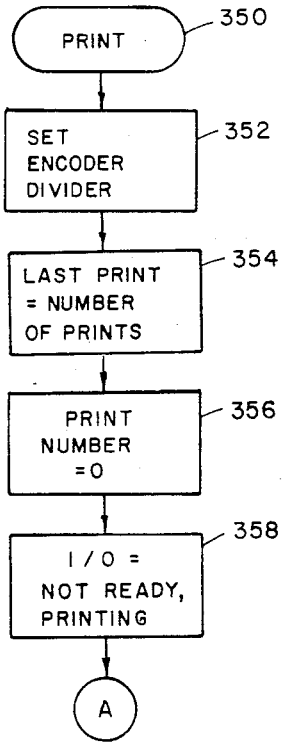
Figure 15D:
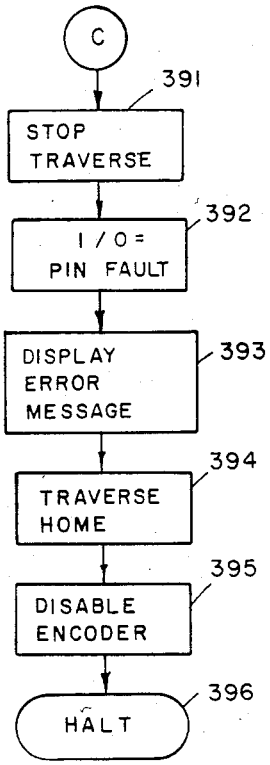
Figure 15B:
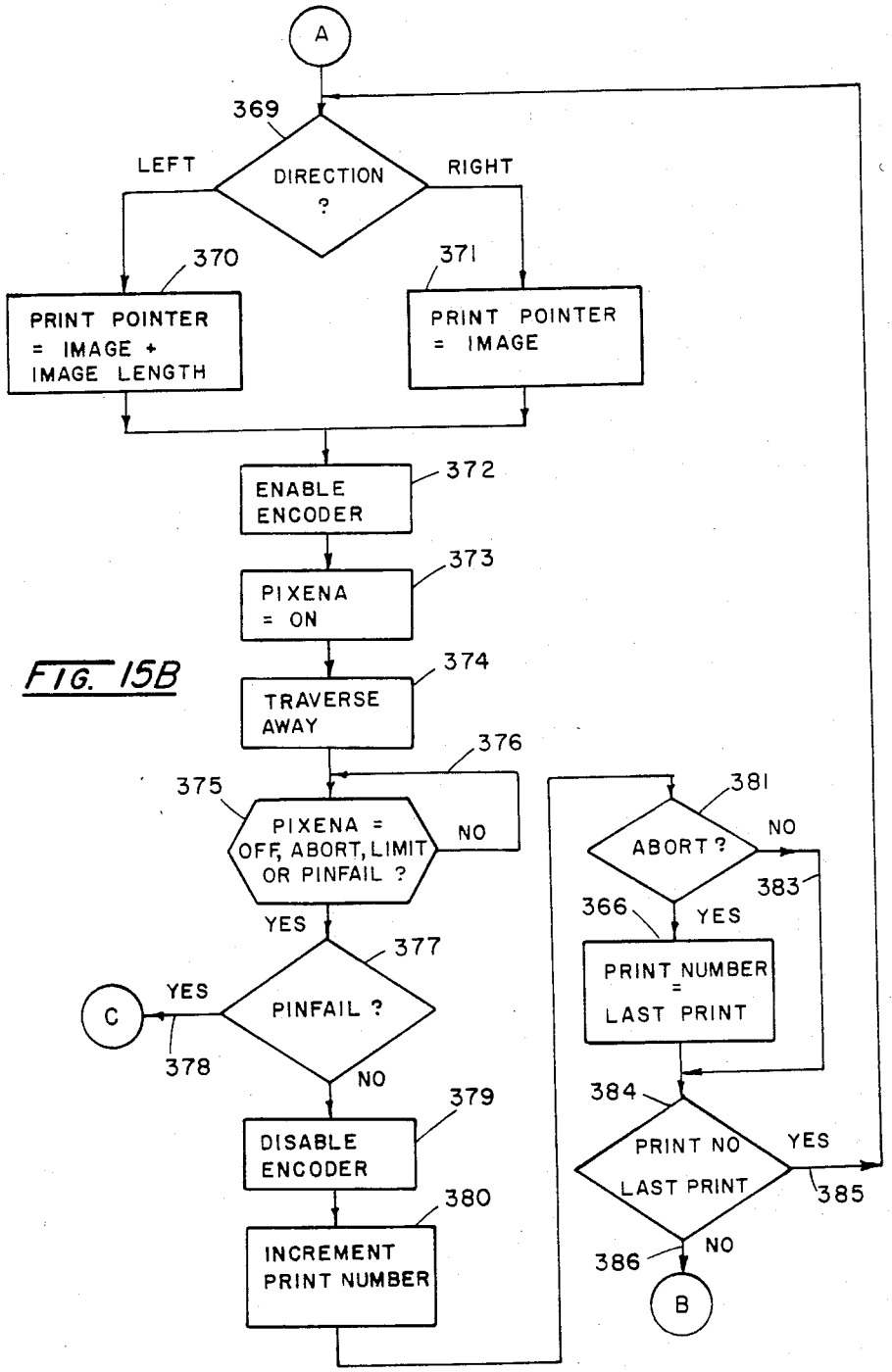

The routine then looks to setting the number of prints desired as represented at block 354, upon which it then progresses to block 356 where a print number counter is initialized at value zero. The program then looks to the next instruction at block 368 wherein an output message is generated indicating that the system is not ready to accept further messages during the printing procedure. The initialization procedures are completed at this juncture and the routine progresses as represented by node A to the inquiry at block 369 as shown in FIG. 15B. Block 369 provides for a determination as to the initial position of carriage 18 as is necessary to determine the direction of its traverse. For this purpose, the arbitrary designations of left and right are provided, a left direction indication leading to block 370 wherein the print pointer operating in conjunction with image memory is positioned at the location of image plus image length. On the other hand, where the designated direction is to the right, then as represented at block 371, the print pointer is located at the image position. The program then proceeds to the instructions at block 372 at which position the pulsed output of the encoder 146 is enabled. In effect, the interrupt function of the microprocessor is enabled with this instruction. The program then proceeds to block 373 wherein a pixel enable flag is turned on to represent a condition wherein a byte of data will not have been sent to the solenoid valve array for marker pin actuation. The program then proceeds to the instructions at block 374 wherein an I/O port is set to permit instructions to cause the carriage 18 to commenced to traverse.

At this juncture, the routine looks for any condition wherein printing should be halted. For example, the pixel enable flag may be turned off, an abort signal may be received from the operator or host terminal, the limit of traverse as detected by the limit switches 148 and 149 may be reached, or a failure due to a broken pin or the like may have been encountered. Loop line 376 extending from block 375 represents that a monitoring of these potential conditions takes place throughout a print. Where one of the conditions set forth in block 375 is at hand, then as represented at block 377, a determination is made as to whether a pin failure has occurred. In the event that it has, then a pin failure subroutine is carried out as represented at line 378 leading to node C. Where a pin failure is not indicted, then the routine proceeds to the instructions at block 379 wherein the program disables encoder 146. In effect, no further interrupt signals will be recognized. The program then proceeds to instructions at block 380 at which position the print number counter is incremented by one. Upon such incrementation, as represented at block 381, a determination is made as to whether the operator or host computer has aborted the print. In the event that is the case, then as represented at block 382, the current print number is made equal to the last message print number to affect a program termination. Where the inquiry at block 381 is in the negative, then as represented by line 383, the routine progresses to the inquiry represented at block 384. This inquiry determines whether the current print number is less than the value of the last print number. In the event of an affirmative response, as represented by loop line 385, the routine proceeds to node A for re-execution. Where the inquiry at block 384 is in the negative, then as represented at line 386 and node B, the subroutine proceeds to a termination routine as represented commencing at node B in FIG. 15C. Referring to that figure, as represented at block 387, with the printing of the last message, an instruction to turn off the carriage 18 drive bit is made as represented by the command "stop traverse". The program then proceeds to the instructions at block 388 at which position a command is provided to set the appropriate I/O command or bit to a condition not to provide print output signals. As represented at block 389, a command then is provided to cause the carriage 18 to traverse to its original or "home" position. As shown at terminal 390, the routine then returns to the calling program.

As described in connection with block 377 in FIG. 15B, in the event of a broke marker pin, the routine diverts to a pin failure subroutine as described in conjunction with FIG. 15D. Looking to that figure, the first command of this routine as represented at block 391 is to stop the traversing of carriage 18. Next, as represented at block 392, the input/output pin fault output is set to a true condition which may be utilized to provide any form of visible or audible indicia of such fault condition. In the event that a visual output is provided for the operator as through a CRT device or the like, as represented at block 393, an error message may be displayed at this point. As represented at block 394, the carriage 18 then is caused to be traversed to its home or initial position. This instruction may be provided optionally in accordance with the wishes of the user. Another approach would be to permit the carriage 18 to remain stationary under the broken marker pin condition. The subroutine then looks to the instructions at block 395 wherein the encoder output 146 is not recognized by the microprocessor and, as represented at terminal 396, the system enters a half condition.

Figure 16A:
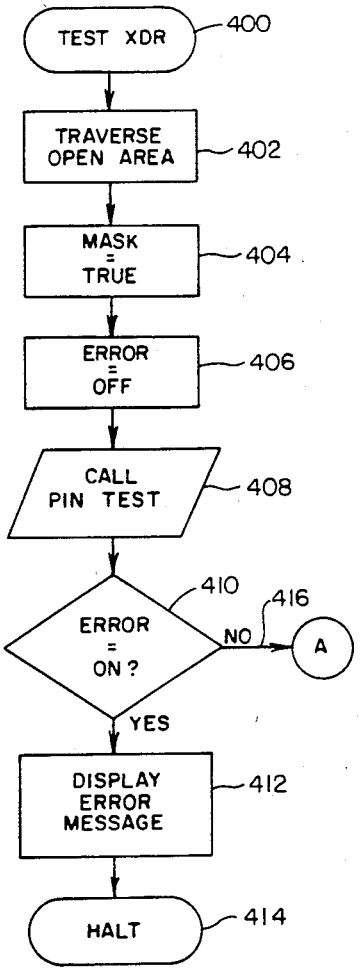
FIG. 16A–16C are a flow diagram showing a marker pin test routine utilized in conjunction with the control system of FIG. 11.
Figure 16B:
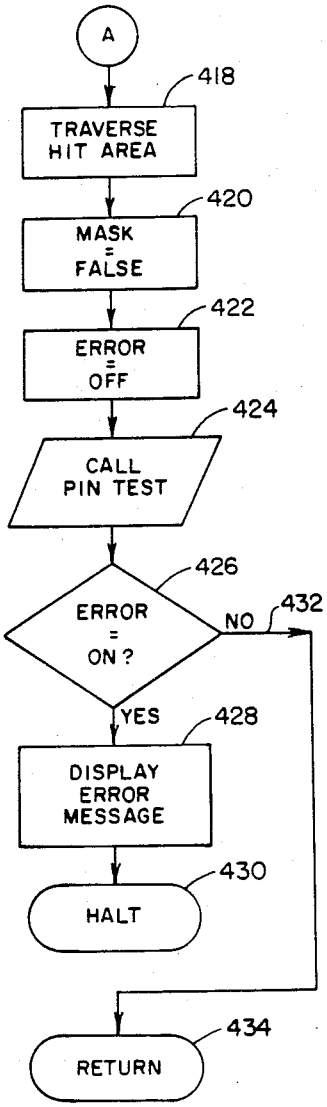
Figure 16C:
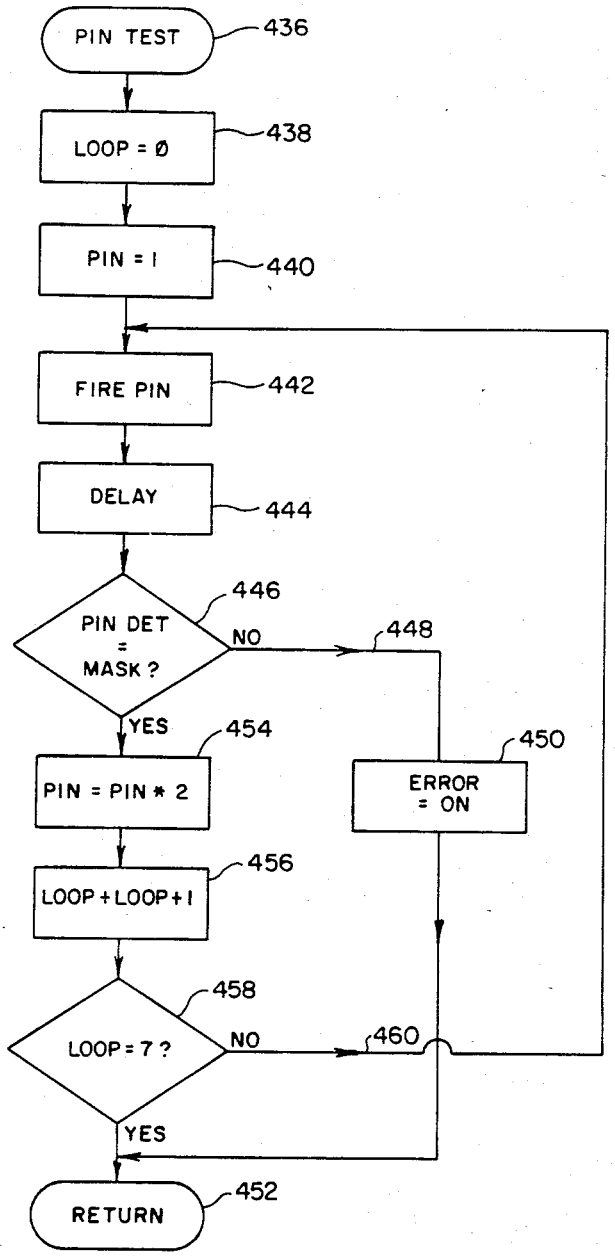

Referring to FIGS. 16A–C, test routines for determining the operational condition of the transducer 166, comparator 128 and the presence of a broken marker pin of the array 88–94 is presented. Looking to FIG. 16A, it may be observed that the subroutine is entered at terminal 400 and progresses to carry out the command represented at block 402. At the latter block, the carriage 18 is caused to traverse to a region where no material 16 is present and the pins within the array may be permitted a full throw to their fully seated orientations as described above in connection with FIG. 6. The routine then carries out the instruction of block 404 wherein a variable or flag identified as "mask" is activated or given a logic value representing that the routine will be looking for a condition wherein the transducer 166 will be oriented to find the presence of air pressure. The routine then progresses to block 406 wherein a flag or a variable designating the presence of an error condition is initiated to an off condition. Following the setting of this flag, as represented at block 408, the pin test subroutine as described later herein in conjunction with FIG. 16C is called. The latter subroutine may determine that an error exists to change the error flag described in conjunction with block 406 to an on condition. Accordingly, as represented at block 410, an inquiry is made as to whether the error flag is on and in the event that it is, as represented at block 412, a display of an error message indicating a defective transducer is provided. This may be effected through the use of an operator terminal CRT or other visible output. Following the display of the error message, as represented at block 414, the test is halted. In the event of a negative response to the inquiry at block 410, as represented at line 416 and node A, the routine commences to test the operation of the marker pins of the array 88–94.

Looking to FIG. 16B, node A again is reproduced and leads to the first instruction at block 418 which causes the carriage 18 to traverse over a material as at 16 such that the marker pins will strike surface 14 and rebound for test purposes. The routine then looks to the instructions at block 420 wherein the earlier-described mask designation is set to provide a false condition representing an output of the transducer 166 indicating no pneumatic pressure detection. This is a condition for proper marker pin performance. The routine then progresses to the instruction of block 422 where, as before, the error variable or flag is turned to an off condition. Following this procedure, as represented at block 424, the pin test subroutine is called as earlier described. At the conclusion of the pin test subroutine, a determination will have been made as to whether a defective marker pin is present. This will be occasioned by the conversion of the error flag to an on condition. An inquiry thus is made as represented at block 426 as to whether the error on condition exists and in the event that it does, then as represented at block 428, an error message indicating defective or broken pin is displayed. The routine then halts the operation of apparatus 10. In the even the query at block 426 indicates no error to be present, then as represented at line 432 and terminal 434, the routine returns to the calling routine.

The pin test routine discussed in conjunction with blocks 408 and 424 is represented by the flow diagram of FIG. 16C. Looking to that figure, an initial counter or looping function is set at a zero value so as to count through the value 6 representing the sequence of seven marker pins. The subroutine then progresses to the instruction at block 440 wherein a pin actuation sequence is set to the value 1 and a signal is sent to the solenoid actuators for purposes of actuating the first marker pin of the series of seven thereof. The subroutine then progresses to the instruction at block 442 at which position the actual firing or actuation of the appropriate solenoid for driving the initial marker pin is provided. At block 444, a delay command is provided to allow the marker pin to travel to its position of contact with the test surface and, if appropriate, rebound to its operational ready orientation. Following this delay, as represented at block 446, an inquiry is made as to whether the output of the transducer 146 is equivalent to the earlier established mask condition as described in conjunction with either block 404 or 420. Where correspondence with respect to the mask condition is not present, then as represented at line 448 and block 450 the error flag is turned on and the subroutine returns to the calling test routine as represented at terminal 452.

Where the inquiry at block 446 indicates a correspondence with the designated mask condition and the detected transducer 146 output, then as represented at block 454, the pin tabulation or counter is incremented in binary fashion and the outer loop is incremented by the value 1 in similar fashion as described at block 336 in FIG. 14C. This command is represented at block 456. Upon the incrementation of the outer loop, as represented at block 458, a determination is made as to whether all seven marker pins have been actuated by observation of the value of the out loop counter. In the event of a negative determination, as represented at line 460, the subroutine returns to fire a next marker pin in the sequence thereof. Where the inquiry at block 458 determines that all marker pins have been actuated, then the subroutine returns to the calling test routine as represented at terminal 452.

As has been discussed above, while the embodiment described herein is one wherein the material 16 is stationary and the carriage 18 is moved, the system operates quite satisfactorily where the opposite arrangement is provided. Generally, for such systems, the encoder 146 is utilized in an orientation where it contacts the moving surface to be marked and provides a pulse characterized signal output corresponding to the instantaneous relative position between surface 14 and head 12, i.e. it "tracks" the movement of surface 14.

Additionally, it will be apparent that the array of marker pins and their associated chambers may be arranged in a fashion other than linear.

Since certain changes may be made in the above-described system and apparatus without departing from the scope of the invention herein involved, it is intended that all matter contained in the description thereof or shown in the accompanying drawings shall be interpreted as illustrative and not in a limiting sense.

I claim:

1. Apparatus for marking solid material objects at a surface thereof with a predetermined character sequence, comprising:

a support structure situable in proximity to said material surface;

head means coupled with said support structure having a confronting surface positionable a predetermined distance from said material surface, an array of discrete chambers within said head means each being configured having a piston receiving portion extending from an abutting position toward a seating surface and communicating with a shaft receiving portion extending from said seating surface toward an opening at said confronting surface, marker pin means within each said chamber, each having a piston portion pneumatically, drivably movable between a first position adjacent said abutting position and said seating surface within said receiving portion and having a shaft portion depending from said piston portion extending to a character component forming surface and slidable within said shaft receiving portion;

drive conduit means in pneumatic communication with said chamber at a location adjacent said abutting surface for selectively driving a select said marker pin means piston defining portion with a drive force toward said seating surface to effect an impacting of said character component forming surface with said material surface;

first valve means actuable for selectively effecting the application and release of gas under select drive pressure to said drive conduit means;

return conduit means in communication with said pin chambers substantially adjacent said seating surface for continuously pneumatically biasing each said piston portion toward said abutting surface at a return force selected having a value less than said drive force for effecting the rapid return of said piston portion towards said first position when said first valve means is actuated to selectively release gas under drive pressure to said drive conduit means;

pressure relief means connected with said return conduit means for limiting sudden pressure build-up at said return conduit means to substantially continuously maintain said return pressure value at said return conduit means; and control means for actuating said first valve means to effect the rapid drive of select said marker pin means piston portions pneumatically from said drive conduit means while simultaneously compressing gas provided from said return conduit means in the region of said chamber substantially situate intermediate said piston portion and said seating surface to derive a selected character formed by the said impacting of said character component forming surface of said marker pin means with said material surface.

2. The apparatus of claim 1 in which said control means comprises:

input means for receiving signals constituting a message for marking upon said material surface;

means for converting said signals to character component signals;

message memory means for retaining said character component signals constituting the entire said message from its commencement to its end; and means for accessing said message means retained character component signals and effecting said first valve means actuation in correspondence therewith.

3. The apparatus of claim 2 in which:

said head means retains said array of discrete chambers oriented at a given angle with respect to the linear extent of said message formed upon said material surface; and said control means includes register means for compiling said character component signals with respect to said given angle.

4. The apparatus of claim 2 in which said control means is responsive to a multiple print command input signal for effecting the actuation of said first valve means to repeat the formation of said message at said material surface for predetermined sequence.

5. The apparatus of claim 2 in which said control means includes:

encoder means for generating a pulse categorized output corresponding with the relative movement between said head means and said material surface;

divider means responsive to said pulse characterized output for carrying out a select extent of division thereof and deriving an actuation timing signal in synchronism therewith;

means for selecting said extent of said division;

said control means effecting said first valve means actuation in synchronism with said actuation timing signal.

6. The apparatus of claim 1 in which:

said support structure includes a receiver component having a head receiver slot and retaining said drive conduit means as a plurality of discrete drive conduits having regularly spaced outlets within said slot;

said head means is slideably mounted within said receiver slot and said discrete chambers thereof are mutually spaced in correspondence with said spaced outlets within said slot; and retainer pin means removably extensible between said head means and said receiver component for selectively coupling said head means with said receiver component and effecting alignment between said discrete chambers and said outlets.

7. The apparatus of claim 1 in which:

said chambers are positioned within said head means as a selectively spaced array; and said head means is selectively rotatable upon said support means to vary the height of a said selected character.

8. The apparatus of claim 1 including means for selectively commingling lubricant with gases supplied to said return conduit means and said drive conduit means.

9. The apparatus of claim 1 wherein said pressure relief means is present as second valve means, and said return pressure selected value is between about 15 p.s.i.g. and 60 p.s.i.g.

10. Apparatus for marking a surface of solid materials with predetermined character defined information comprising:

a support structure situable in proximity to said material surface;

head means coupled with said support structure including:

a confronting surface positionable a predetermined distance from said material surface, an array of discrete chambers within said head means, each being configured having a piston receiving portion extending from a first chamber position toward a seating surface and having a shaft receiving portion extending to an opening at said confronting surface, marker pin means within each said chamber, each having a piston defining portion of predetermined length extending from a top surface, a travel limiting surface and a shaft portion depending from said piston portion extending to a character component forming surface, said marker pin means being pneumatically drivably movable from a first position wherein said top surface is adjacent said first chamber position to a second position wherein said travel limiting surface abuts said seating surface and movable to a third position intermediate said first and second positions for effecting indenting contact with said material surface;

drive conduit means in pneumatic communication with said chambers at a location adjacent said first position for selectively driving a said marker pin means toward said second position;

valve means actuable for selectively effecting the application and release of gas under select drive pressure to said drive conduit means;

monitoring conduit means in pneumatic communication with each said chamber at outlets positioned adjacent to and blocked by said piston defining portion when said marker pin means is moved between said first and third positions, said outlets being unblocked by said piston defining portion when said marker pin means is in said second position;

sensor means coupled in pneumatic communication with said monitoring conduit means and having a predetermined output condition when a said outlet is unblocked;

return means for moving said marker pin means toward said first position; and control means for actuating said valve means to derive a selected character formed by the impacting of said character component forming surfaces with said material surface and responsive to said sensor means output condition for deriving a position signal representing a movement of said marker pin means to said second position.

11. The apparatus of claim 10 in which said control means is responsive in a first test mode to actuate said valve means to effect the pneumatically driven movement of said marker pin means in a predetermined sequence thereof, to move from said first position to said second position, and is responsive in the absence of said sensor means predetermined output condition corresponding with a said actuation to provide an error signal.

12. The apparatus of claim 10 in which said control means is responsive in a second test mode to actuate said valve means to effect the pneumatically driven movement of said marker pin means in a predetermined sequence thereof to move from said first position to said third position wherein said character component forming surface impacts a test said material surface, and is reponsive to said sensor means predetermined output condition corresponding with a said actuation to provide said position signal as an error signal.

13. The apparatus of claim 10 in which said control means is responsive in a first test mode to actuate said valve means to effect the pneumatically driven movement of said marker pin means in a predetermined sequence thereof, to move from said first position to said second position, and is responsive in the absence of said sensor means predetermined output condition corresponding with a said actuation to provide an error signal; and in which said control means is responsive in a second test mode to actute said valve means to effect the pneumatically driven movement of said marker pin means in a predetermined sequence thereof to move from said first position to said third position wherein said character component forming surface impacts a test said material surface, and is responsive to a said sensor means predetermined output condition corresponding with a said actuation to provide said position signal as an error signal.

14. The apparatus of claim 10 in which said control means is responsive to said sensor means output condition for halting the said actuation of said valve means and providing said position signal as an error signal.

15. The apparatus of claim 10 in which said control means comprises:

input means for receiving signals constituting a message for marking upon said material surface;

means for converting said signals to character component signals;

message memory means for returning said character component signals constituting the entire said message from its commencement to its end; and means for accessing said message means retained character component signals and effecting said first valve means actuation.

16. The apparatus of claim 15 in which:

said head means retains said array of discrete chambers in selective alignment oriented at a given angle with respect to the linear extent of said message formed upon said material surface; and said control means includes register means for compiling said character component signals with respect to said given angle.

17. The apparatus of claim 15 in which said control means is responsive to a multiple print command input signal for effecting the actuation of said first valve means to repeat the formation of said message at said material surface for predetermined sequence.

18. Apparatus for marking solid material objects at a surface thereof with a predetermined character sequence, comprising:

a support structure suitable in proximity to said material surface;

head means coupled with said supporting structure and including:

a confronting surface positionable a predetermined distance from said material surface, an array of selectively spaced discrete chambers within said head means, each being configured having a piston receiving portion extending from a first chamber position toward a seating surface and communicating with a shaft receiving portion extending substantially from said seating surface to an opening at said confronting surface; and marker pin means within each said chamber, each having a piston portion of first diametric extent and predetermined length extending from a top surfce, a travel limiting surface and a shaft portion of second diametric extent less than said first diametric extent depending from said piston portion, extending to a character component forming surface and slidable within said shaft receiving portion, said marker pin means being pneumatically drivably movable from a first position wherein said top surface is adjacent said first chamber position to a second position wherein said travel limiting surface abuts said seating surface and movable to a third position intermediate said first and second positions for effecting indenting contact with said material surface;

drive conduit means in pneumatic communication with said chamber at a location adjacent said first position for selectively driving said marker pin means toward said second position;

first valve means actuable for selectively effecting the application and release of gas under select drive pressure into said drive conduit means;

return means for moving said marker pin means toward said first position;

monitoring means for monitoring the extent of movement of each said marker pin means and having a predetermined output condition when said marker pin means is in said second position; and control means for actuating said first valve means to derive a selected character formed by the impacting of said character component forming surfaces with said material surface and responsive to said monitoring means output condition for deriving a position signal representing a movement of said marker pin means to said second position.

19. The apparatus of claim 18 in which said return means comprises:

return conduit means in communication with said chambers substantially adjacent said seating surface for pneumatically biasing each said piston portion toward said first chamber position; and second valve means connected with said return conduit means for limiting the return gas pressure at said return conduit means, said limited return pressure being selected of value less than said drive pressure.

20. The apparatus of claim 18 in which said monitoring means comprises:

monitoring conduit means in pneumatic communication with each said chamber at outlets positioned adjacent to and blocked by said piston defining portion when said marker pin means is moved between said first and third positions, said outlets being unblocked by said piston portion when said marker pin means is in said second position; and sensor means coupled in pneumatic communication with said monitoring conduit means for deriving said predetermined output condition.

* * * * *